US008901445B2

(12) United States Patent
Tachikawa et al.

(10) Patent No.: US 8,901,445 B2
(45) Date of Patent: Dec. 2, 2014

(54) MAGNETIC CONTACTOR

(75) Inventors: Hiroyuki Tachikawa, Yokohama (JP); Masaru Isozaki, Ichihara (JP); Yuji Shiba, Kounosu (JP)

(73) Assignees: Fuji Electric FA Components & Systems Co., Ltd., Tokyo (JP); Fuji Electric Co., Ltd., Kawasaki-shi (JP)

( * ) Notice: Subject to any disclaimer, the term of this patent is extended or adjusted under 35 U.S.C. 154(b) by 449 days.

(21) Appl. No.: 13/338,075

(22) Filed: Dec. 27, 2011

(65) Prior Publication Data

US 2012/0175344 A1 Jul. 12, 2012

(30) Foreign Application Priority Data

Jan. 12, 2011 (JP) ..... 2011-004177

(51) Int. Cl.
*H01H 9/44* (2006.01)
*H01H 50/54* (2006.01)

(52) U.S. Cl.
USPC ..... 218/26; 335/201

(58) Field of Classification Search
CPC ..... H01H 9/30; H01H 9/44; H01H 50/00; H01H 50/02; H01H 50/54; H01H 50/58
USPC ..... 218/26, 22, 23, 30, 31; 335/132, 133, 335/195, 78–86, 201; 200/243
See application file for complete search history.

(56) References Cited

U.S. PATENT DOCUMENTS

| | | | | |
|---|---|---|---|---|
| 4,523,165 | A | 6/1985 | Schedele | |
| 6,700,466 | B1 * | 3/2004 | Yamamoto et al. | 218/156 |
| 7,145,422 | B2 * | 12/2006 | Imanishi et al. | 335/201 |
| 8,390,410 | B2 | 3/2013 | Kojima et al. | |

FOREIGN PATENT DOCUMENTS

| | | | |
|---|---|---|---|
| FR | 673798 | A | 1/1930 |
| FR | 2946793 | A1 | 12/2010 |
| JP | S45-21971 | Y1 | 9/1970 |
| JP | S60-107551 | U | 7/1985 |
| JP | 07-235248 | | 9/1995 |
| JP | 2005-19161 | A | 1/2005 |
| JP | 2008-226547 | | 9/2008 |

OTHER PUBLICATIONS

France Patent Office, "Search Report and Written Opinion for FR 1200006", Jan. 24, 2014.
Japan Patent Office, "Office Action for JP 2011-004177," Aug. 12, 2014.

* cited by examiner

*Primary Examiner* — Amy Cohen Johnson
*Assistant Examiner* — Marina Fishman
(74) *Attorney, Agent, or Firm* — Manabu Kanesaka

(57) ABSTRACT

A magnetic contactor has a stationary contact including a first and second stationary contact pieces, each having a stationary contact portion and a stationary terminal portion, a third stationary contact piece disposed between the first stationary contact piece and the second stationary contact piece and having two stationary contact portions; a contact support casing supporting the stationary contact with the stationary terminal portions protruding out of the contact support casing; and a movable contact installed in the contact support casing, and including a first and second movable contact pieces contactable and separable from the stationary contact portions of the stationary contact pieces and the stationary contact portions of the third stationary contact piece accordingly, and an insulator fixing the first movable contact piece and the second movable contact piece. A driving mechanism drives the movable contact to contact and separate from the stationary contact.

8 Claims, 13 Drawing Sheets

MAGNETIC CONTACTOR

CROSS-REFERENCE TO RELATED APPLICATION

This application is based on, and claims priority to, Japanese Patent Application No. 2011-004177, filed on Jan. 12, 2011, contents of which are incorporated herein by reference.

BACKGROUND OF THE INVENTION

1. Field of the Invention

The present invention relates to a magnetic contactor having a stationary contact and a movable contact and inserted in a current path, in particular to a magnetic contactor that facilitates extinguishing the arc generated at the time of opening the movable contact from the stationary contact, that is, at the time of current interruption.

2. Description of the Related Art

Magnetic contactors are installed in high voltage direct current power supply circuits for use in electric vehicles, hybrid vehicles and the like. An example of a conventional magnetic contactor, which is a plunger type magnetic contactor disclosed in Patent Document 1, comprises, as shown in FIGS. 9 and 10, a pair of stationary contacts 101 and 102 disposed with a predetermined distance therebetween in a housing 100, movable contacts 103 and 104 disposed opposing the stationary contacts 101 and 102 and allowing closing and opening motion with respect to the stationary contacts, a movable contact holder 105 holding the pair of movable contacts at both ends thereof, and a pair of arc extinguishing means 106 and 107 for extinguishing the arcs that develop in the contact gaps between the pair of stationary contacts 101 and 102 and the pair of movable contacts 103 and 104. Each of the arc extinguishing means 106 and 107 is composed of a pair of permanent magnets with the magnetic pole faces thereof opposing across the contact gap exposing opposite polarities.

The principle of arc extinguishing operation of this conventional example is described in the following with reference to FIGS. 10 through 13. In the current carrying state, the movable contact holder 105 has made the movable contacts 103 and 104 to contact the stationary contacts 101 and 102 to allow an electric current to flow from the stationary contact 101 through the movable contacts 103 and 104 to the stationary contact 102. In the current interruption state, the movable contact holder 105 has been moved upward by solenoid coils (not depicted in the figures) to separate the movable contacts 103 and 104 from the stationary contacts 101 and 102. Turning the current carrying state into the current interruption state generates an arc 108 in the gaps between the stationary contacts 101 and 102 and the movable contacts 103 and 104 as shown in FIG. 11.

The arc extinguishing means 106 and 107 are so arranged that the magnetic flux Φ is generated, as shown in FIG. 12, in the direction orthogonal to the arc 108 and also perpendicular to the page of FIG. 12. The magnetic flux Φ exerts an electromagnetic force, the Lorenz force, on the arc 108 and, as shown in FIG. 12, moves the arc 108 towards the both outer ends in the direction of the arrangement of the stationary contacts 101 and 102 according to the Fleming's left hand rule corresponding to the directions of the magnetic flux and the arc current. Thus, the arcs 108, 108 are extended to the arc extinguishing spaces 109, 109 indicated in FIG. 9 provided in the both end places in the direction of arrangement of the stationary contacts 101 and 102, to be extinguished there.

When the current flows in the reversed direction, that is, from the stationary contact 102 through the movable contacts 104, 103 to the stationary contact 101, as shown in FIG. 13, the arc 108 generated between the stationary contact 101 and the movable contact 103 and the arc 108 generated between the stationary contact 102 and the movable contact 104 are extended inward in the direction of arrangement of the stationary contacts 101 and 102, to be extinguished there.

The current interruption in the conventional example disclosed in Patent Document 1 is performed by increasing the arc voltage beyond the power supply voltage owing to the extended arcs. The arc voltage is determined by the product of the arc electric field and the arc length. Consequently, interruption for a large power supply voltage needs an increased arc electric field or an elongated arc length.

A magnitude of the arc electric field in a gaseous environment is determined by the gas pressure and the type of the gas. The arc electric field can generally be increased by elevating the gas pressure or using a gas exhibiting a large arc electric field such as hydrogen. However, the high gas pressure needs the vessel to be air tight and reinforced, which causes a problem of enlarged vessel. The use of a high arc electric field gas such as hydrogen needs an enlarged gap between contacts in the opened state due to deteriorated breakdown voltage of such a gas, which causes another problem of enlarged solenoid coil for driving the movable contact holder.

Elongation of the arc length, on the other hand, needs to provide such an arc space that ensures a long arc length, which causes a problem of enlarged housing.

In order to cope with these unsolved problems, Patent Document 2 discloses an electromagnetic relay in which a pair of arc extinguishing magnetic bodies is arranged with the opposing faces in different polarity at places of both outside ends of a row of stationary contacts and arc extinguishing spaces are provided for extending the arcs by the Lorenz force produced on the basis of the magnetic flux from the arc extinguishing magnetic bodies in the both sides of each arc extinguishing magnetic body, the both sides positioning in the directions perpendicular to the direction of the row of stationary contacts and also perpendicular to the direction of the open/close movement of the stationary and movable contacts.

[Patent Document 1]

Japanese Unexamined Patent Application Publication No. H07-235248

Japanese Unexamined Patent Application Publication No. 2008-226547

The conventional example disclosed in Patent Document 2 still has a problem of elongated dimension in the direction of arrangement of the stationary contacts because the arc extinguishing magnetic bodies are disposed at the places of both outside ends of the row of stationary contacts. The electromagnetic relay of Patent Document 2 avoids the interference between arcs regardless of the current flow direction because arc extinguishing spaces are disposed at the both sides of the arc extinguishing magnetic body in the direction perpendicular to arrangement of the stationary contacts. In the configuration of this conventional example, however, the width in the direction perpendicular to arrangement of stationary contacts must be elongated in order to ensure necessary arc length for extending the arc to interrupt a high power supply voltage. Thus, this conventional example too, does not meet the requirement for size reduction of a magnetic contactor, leaving an unsolved problem.

SUMMARY OF THE INVENTION

The present invention has been accomplished in view of the unsolved problems described above, and an object of the invention is to provide such a magnetic contactor that achieves size reduction while ensuring a necessary arc length of extended arc even in the case of interrupting a high power supply voltage.

To accomplish the above objects, a magnetic contactor according to the present invention comprises a stationary contact including a first stationary contact piece having a stationary contact portion and a stationary terminal portion connecting to a power supply, a second stationary contact piece having a stationary contact portion and a stationary terminal portion connecting to a load, and a third stationary contact piece disposed between the first stationary contact piece and the second stationary contact piece and having two stationary contact portions; a contact support casing supporting the stationary contact with the stationary terminal portions of the first stationary contact piece and the second stationary contact piece protruding out of the contact support casing; a movable contact including a first movable contact piece allowed to contact with and separate from the stationary contact portion of the first stationary contact piece and one of the two stationary contact portions of the third stationary contact piece, and a second movable contact piece allowed to contact with and separate from the stationary contact portion of the second stationary contact piece and the other stationary contact portion of the third stationary contact piece, and an insulator fixing the first movable contact piece and the second movable contact piece, the movable contact being installed in the contact support casing; and a driving mechanism for driving the movable contact to contact with and separate from the stationary contact.

According to this construction, in the power supply terminal side, two arc-developing places are formed at the contact place between the stationary contact portion of the first stationary contact piece and the first movable contact piece and at the contact place between the stationary contact portion of the third stationary contact piece and the first movable contact piece. At the same time, in the load terminal side, two arc-developing places are formed at the contact place between the stationary contact portion of the third stationary contact piece and the second movable contact piece and at the contact place between the stationary contact portion of the second stationary contact piece and the second movable contact piece. Thus, total of four arc-developing places are provided.

In addition, a pair of arc extinguishing magnetic bodies is provided as described afterwards for extending the arc developed at the contact places, generating magnetic flux in the longitudinal direction, the direction of the row of the stationary contact pieces. Arc extinguishing spaces are formed in the contact support casing in the side toward the direction perpendicular to both the directions of the arc current and the magnetic flux generated by the arc extinguishing magnetic bodies.

In the power supply terminal side, the direction of current flow at the contact place between the first stationary contact piece and the first movable contact piece is reversed from the direction of current flow at the contact place between the third stationary contact piece and the first movable contact piece. As a consequence, the arcs developed at the two contact places are extended toward reversed directions. Therefore, the arcs do not interfere with each other and thus, the two adjacent contact places can be positioned with a small distance. Likewise in the load terminal side too, two adjacent contact places can be positioned with a small distance.

And each of the power supply side terminal and the load side terminal is hardly minimized because it has a female screw for connecting to an external terminal, posing limitation on minimizing the distance between the stationary terminal portions of the two terminals.

The present invention conveniently utilizes this space between the stationary contact portions and provides the third stationary contact piece in the space. Thus, the number of arc developing places is increased and the total arc length is elongated. Therefore, a higher voltage can be interrupted by a device of the invention with the same size as that of conventional devices.

Preferably, the magnetic contactor according to the present invention further comprises a pair of arc extinguishing magnetic bodies arranged in parallel to sandwich each of the stationary contact pieces and the movable contact, and having the same polarity from opposing magnetic pole faces.

According to this construction, the magnetic flux out of or into the opposing magnetic pole faces of the pair of arc extinguishing magnetic bodies flows through the arc developing places between the stationary contact portions of the stationary contact pieces and the movable contact pieces in the direction of the row of the stationary contact portions. As previously described, in the power supply side, the direction of current flow at the contact place between the first stationary contact piece and the first movable contact piece is reversed from the direction of current flow at the contact place between the third stationary contact piece and the first movable contact piece, while the direction of the magnetic flux flow is the same at both contact places. Consequently, the Lorenz force exerted on the current at the contact place between the first stationary contact piece and the first movable contact piece is directed toward one of the two opposing arc extinguishing magnetic bodies, permanent magnets, disposed in the direction of the row of the stationary contact pieces and the Lorenz force exerted on the current at the contact place between the third contact piece and the first movable contact piece is directed toward the other permanent magnet. Thus, the developed arcs are extended toward opposite directions and extinguished at respective opposite destination space. Similarly in the load side, the Lorenz force exerted on the current at the contact place between the second stationary contact piece and the second movable contact piece is directed toward one of the two opposing permanent magnets disposed in the direction of the row of the stationary contact pieces and the Lorenz force exerted on the current at the contact place between the third contact piece and the second movable contact piece is directed toward the other permanent magnet. Thus, the developed arcs are extended toward opposite directions and extinguished at respective opposite destination space. Therefore, the total arc length is elongated and a high voltage can be interrupted.

Preferably, in the magnetic contactor according to the present invention, both the opposing magnetic pole faces of the pair of arc extinguishing magnetic bodies are N-poles.

According to this construction, in each of the power supply side and the load side, the magnetic flux out of the pair of arc extinguishing magnetic bodies passes through the central region, in which the arc developing places are located, between the pair of arc extinguishing magnetic bodies. Thus, the Lorenz forces are exerted on the developed arcs in the opposite directions perpendicular to the row of the stationary contact pieces within each of the power supply side and the load side.

Preferably, in the magnetic contactor according to the present invention, both the opposing magnetic pole faces of the pair of arc extinguishing magnetic bodies are S-poles.

According to this construction, in each of the power supply side and the load side, the magnetic flux out of the rear surface of the pair of arc extinguishing magnetic bodies passes through the central region, in which the arc developing places are located, between the pair of arc extinguishing magnetic bodies and returns to the S-poles. Thus, the Lorenz forces are exerted on the developed arcs in the opposite directions perpendicular to the row of the stationary contact pieces within each of the power supply side and the load side.

Preferably, in the magnetic contactor according to the present invention, the pair of arc extinguishing magnetic bodies is disposed on outer surfaces of side walls of the contact support casing.

According to this construction, the pair of arc extinguishing magnetic bodies is readily mounted.

Preferably, in the magnetic contactor according to the present invention, the arc extinguishing spaces are formed inside the inner surface of the side walls of the contact support casing on which the pair of arc extinguishing magnetic bodies is disposed.

According to this construction, the arc developed from the current supplying-stationary contact piece to the current-receiving movable contact piece is extended, owing to the Lorenz force due to the magnetic flux generated by the pair of arc extinguishing magnetic bodies, from the side surface of the current supplying stationary contact piece through the arc extinguishing space separated from the side surfaces of the stationary contact piece and the movable contact piece, to the rear surface side of the movable contact piece. The path of the extended arc can be altered.

Preferably, the magnetic contactor according to the present invention further comprises partition walls made of an insulating material disposed in central region of the arc extinguishing spaces, each partition wall dividing each of the arc extinguishing spaces into a portion on a side of the first movable contact piece and a portion on a side of the second movable contract piece.

According to this construction, interference of arcs is avoided without failure by separating with the partition walls, the arc developed between the stationary contact portion of the third stationary contact piece and the first movable contact piece and the arc developed between the stationary contact portion of the third stationary contact piece and the second movable contact piece.

The magnetic contactor according to the present invention comprises a stationary contact including a first stationary contact piece, a second stationary contact piece, and a third stationary contact piece disposed between the first stationary contact piece and the second stationary contact piece and having two stationary contact portions; and a movable contact including a first movable contact piece opposing to the stationary contact portion of the first stationary contact piece and one of the two stationary contact portions of the third stationary contact piece, and a second movable contact piece opposing to the stationary contact portion of the second stationary contact piece and the other stationary contact portion of the third stationary contact piece, and an insulator fixing the first movable contact piece and the second movable contact piece. In this construction of a magnetic contactor of the invention, the number of arc developing places is increased. Extinguishing the arcs at the increased number of arc extinguishing places elongates the total arc length, allowing interruption of a high voltage. Therefore, a magnetic contactor of the invention having an equivalent size as that of the conventional one can interrupt a higher voltage.

In the power supply side, the direction of the current running through the contact place between the first movable contact piece and the stationary contact portion of the first stationary contact piece contacting the first movable contact piece is reversed from the direction of the current running through the contact place between the first movable contact piece and the stationary contact portion of the third stationary contact piece contacting the first movable contact piece. Consequently, the arcs developed at the contact places are extended toward the arc extinguishing spaces in the different directions. Hence, interference between those arcs does not take place and the distance between the contact places can be reduced. Similarly in the load side, the distance between the contact places can be reduced. Therefore, the length of the magnetic contactor in the direction of the row of the stationary contact pieces is reduced.

As described earlier, the first stationary contact piece and the second stationary contact piece are hardly reduced in their size because they each have a female screw hole for connecting an external terminal. Thus, a limitation is posed on reduction of the distance between the first stationary contact piece and the second stationary contact piece. Conveniently utilizing this limitation, the third stationary contact piece is disposed between the first stationary contact piece and the second stationary contact piece in the magnetic contactor according to the invention.

Since the directions of the current running through the adjacent contact places are reversed, the Lorenz forces exerted at the contact places are also reversed. Toward which arc extinguishing space in the both sides of the row of stationary contact pieces the arc actually extends is determined by the direction of the current running in the contact place in question. Since a magnetic contactor of the invention is provided with arc extinguishing spaces in the both sides of the row of the stationary contact pieces and the row of the movable contact pieces, arc extinguishing is performed irrespective of the direction of the arc current running at the contact place. Therefore, satisfactory arc extinguishing function is performed in the case a regenerative current returns from the load side to the power supply side as well as in the case of the current flow from the power supply side to the load side.

DETAILED DESCRIPTION OF THE INVENTION

Now, some preferred embodiments according to the present invention will be described in the following with reference to the accompanying drawings.

Figure 1:
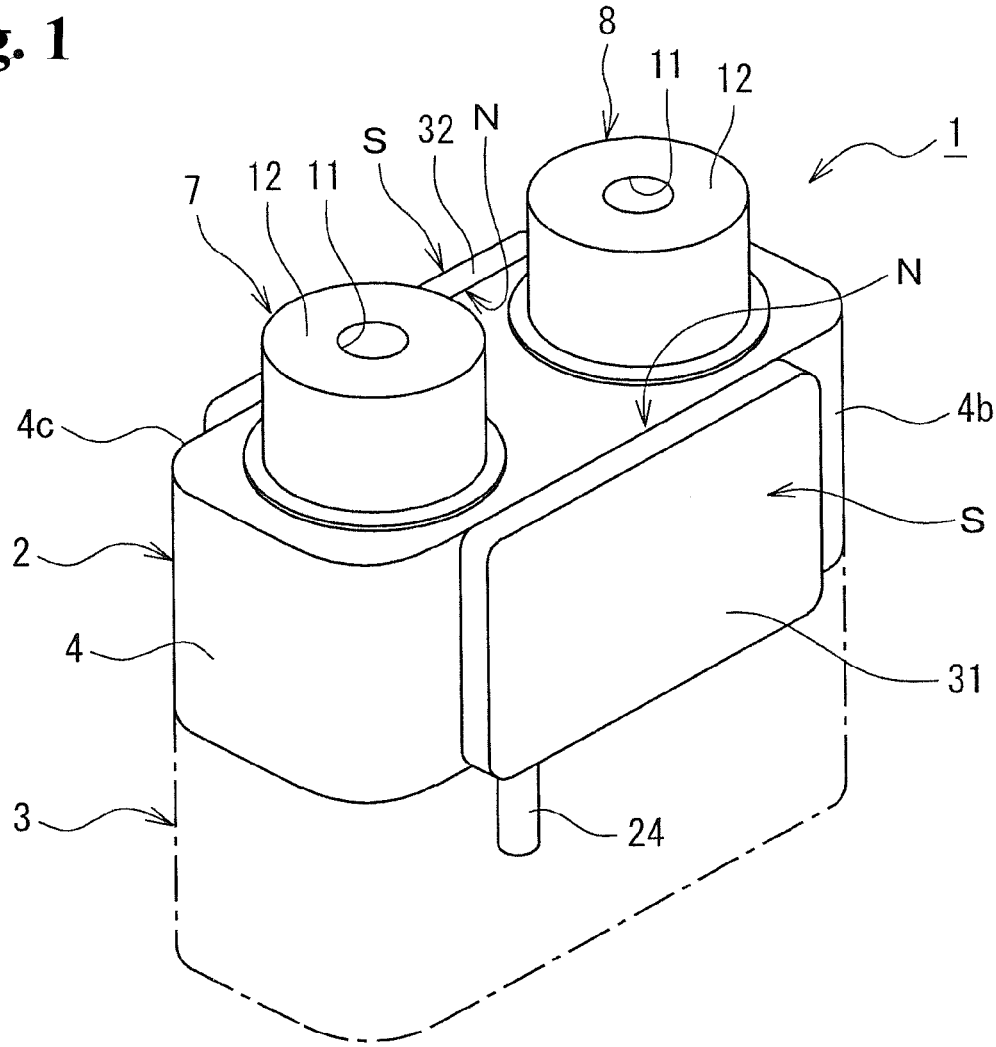
FIG. 1 is a perspective view of an embodiment example of a magnetic contactor according to the present invention.

Referring first to FIG. 1, which is a perspective view of a magnetic contactor of an embodiment according to the present invention, the reference numeral 1 represents the magnetic contactor having a contact mechanism 2 in the upper portion and a driving mechanism 3 in the lower portion.

Figure 2:
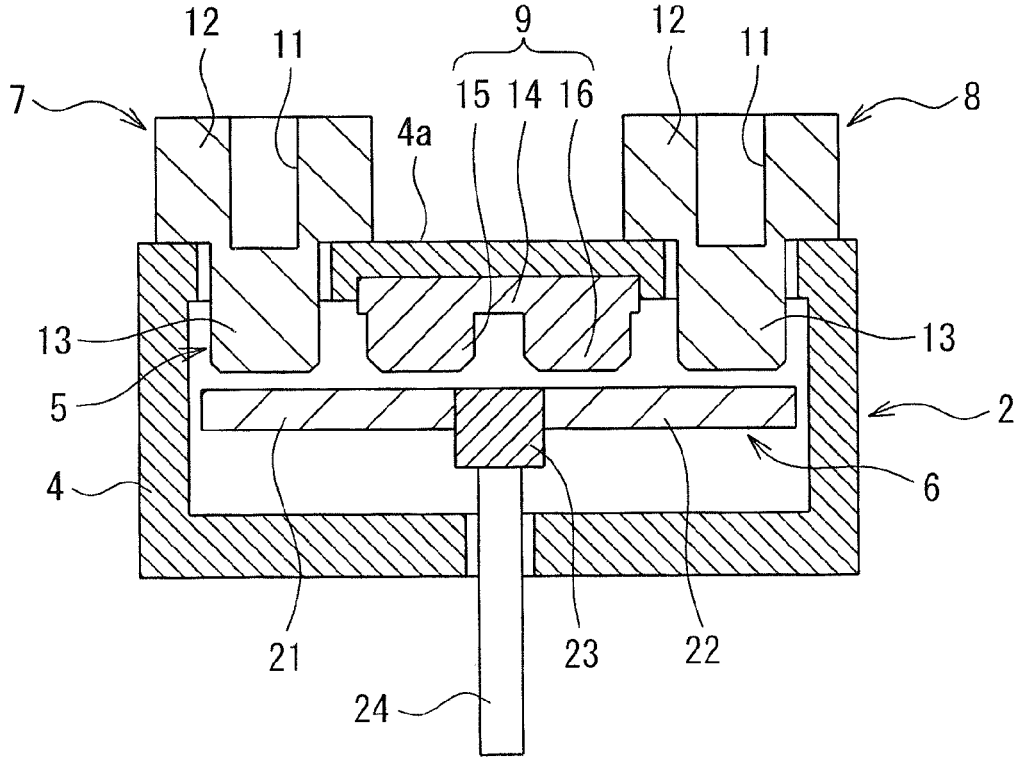
FIG. 2 is a cross-sectional view of the contact mechanism 2 shown in FIG. 1 taken through a plane in the longitudinal direction.

The contact mechanism 2 comprises, as shown in FIG. 2, a contact support casing 4 in a rectangular parallelepiped shape made of an insulating material, and a stationary contact 5 and a movable contact 6, the both made of electrically conductive material and supported by the contact support casing 4.

The stationary contact 5 includes a first stationary contact piece 7 and a second stationary contact piece 8 fixed on the top plate 4*a* of the contact support casing 4 with a predetermined distance between the stationary contact pieces. The stationary contact 5 further includes a third stationary contact piece 9 fixed on the lower surface of the top plate 4*a* between the first stationary contact piece 7 and the second stationary contact piece 8 with a predetermined insulation distance from the first stationary contact piece 7 and the second stationary contact piece 8.

Each of the first stationary contact piece 7 and the second stationary contact piece 8, as shown in FIG. 2, has a stationary terminal portion 12 and a stationary contact portion 13. The stationary terminal portion 12, in a cylindrical shape, is projecting out of the top plate 4*a* of the contact support casing 4 and has a female screw 11 formed from the top plane of the stationary terminal portion. The stationary contact portion 13, in a cylindrical shape having a diameter smaller than that of the stationary terminal portion 12, continues downward from the stationary terminal portion 12.

Connected to the stationary terminal portion 12 of the first stationary contact piece 7 is an external connection terminal wired to a high voltage DC power supply at several hundred volts, for example; and connected to the stationary terminal portion 12 of the second stationary contact piece 8 is an external wiring to the load.

The third stationary contact piece 9, as shown in FIG. 2, has a flat plate portion 14 and two stationary contact portions 15 and 16. The flat plate portion 14 made of an electrically conductive material has a width smaller than a length in the left and right direction in FIG. 2 and extends between the first stationary contact piece 7 and the second stationary contact piece 8. The stationary contact portions 15 and 16 each having a cylindrical shape are protruding downward from the lower plane of the flat plate portion 14 at the both end sides of the flat plate portion 14 with a rather short predetermined distance in the left and right direction from each other. The stationary contact portions 15 and 16 are protruding downward in such an extent that the bottom planes of the stationary contact portions 15 and 16 are in correspondence with the bottom planes of the stationary contact portions 13 of the first and second stationary contact pieces 7 and 8 in the condition of the third stationary contact piece 9 fixed on the top plate 4*a* of the contact support casing 4 as shown in FIG. 2.

The movable contact 6 has a first movable contact piece 21, a second movable contact piece 22, and an insulator 23. The first movable contact piece 21 opposes the stationary contact portion 13 of the first stationary contact piece 7 and the stationary contact portion 15 of the third stationary contact piece 9. The second movable contact piece 22 opposes the stationary contact portion 16 of the third stationary contact piece 9 and the stationary contact portion 13 of the second stationary contact piece 8. The insulator 23 is an insulating part that fixedly supports the first movable contact piece 21 and the second movable contact piece 22. The insulator 23 is linked through a shaft 24 to the driving mechanism 3 provided under the contact mechanism 2.

The driving mechanism 3, though not illustrated in the figures, has an excitation coil wound on a coil bobbin, a magnetic core and a plunger disposed inside the coil bobbin. The plunger is fixed to the shaft 24. When the excitation coil is not carrying current, the contact mechanism 2 is in an opened state in which the first and second movable contact pieces 21 and 22 are separated downward from the stationary contact portions 13, 13, 15, and 16 of the first stationary contact piece 7, the second stationary contact piece 8, and the third stationary contact piece 9 with a predetermined distance. From this opened state of the contact mechanism 2, when the excitation coil is supplied with current, the plunger is moved upward, moving the insulator 23 and the first and second movable contact pieces 21 and 22 upward through the shaft 24. As a result, the first movable contact piece 21 contacts the stationary contact portion 13 of the first stationary contact piece 7 and the stationary contact portion 15 of the third stationary contact piece 9. At the same time, the second movable contact piece 22 contacts the stationary contact portion 16 of the third stationary contact piece 9 and the stationary contact portion 13 of the second stationary contact piece 8. Thus, the contact mechanism 2 turns to the closed state.

A pair of arc extinguishing magnetic bodies 31 and 32 is provided on the outer side surfaces 4*b* and 4*c* of the contact support casing 4 as shown in FIG. 1. The outer side surfaces 4*b* and 4*c* are in parallel to the row of the first stationary contact piece 7, the third stationary contact 9, and the second stationary contact piece 8 of the stationary contact 5. The arc extinguishing magnetic bodies 31 and 32 are disposed opposing each other and fixed on the outer side surfaces with an adhesive, for example. The arc extinguishing magnetic bodies 31 and 32 are magnetized in the direction of their thickness. The opposing magnetic pole surfaces, which are inner surfaces, are N-poles and the rear surface, which are outer surfaces, are S-poles.

Figure 3:
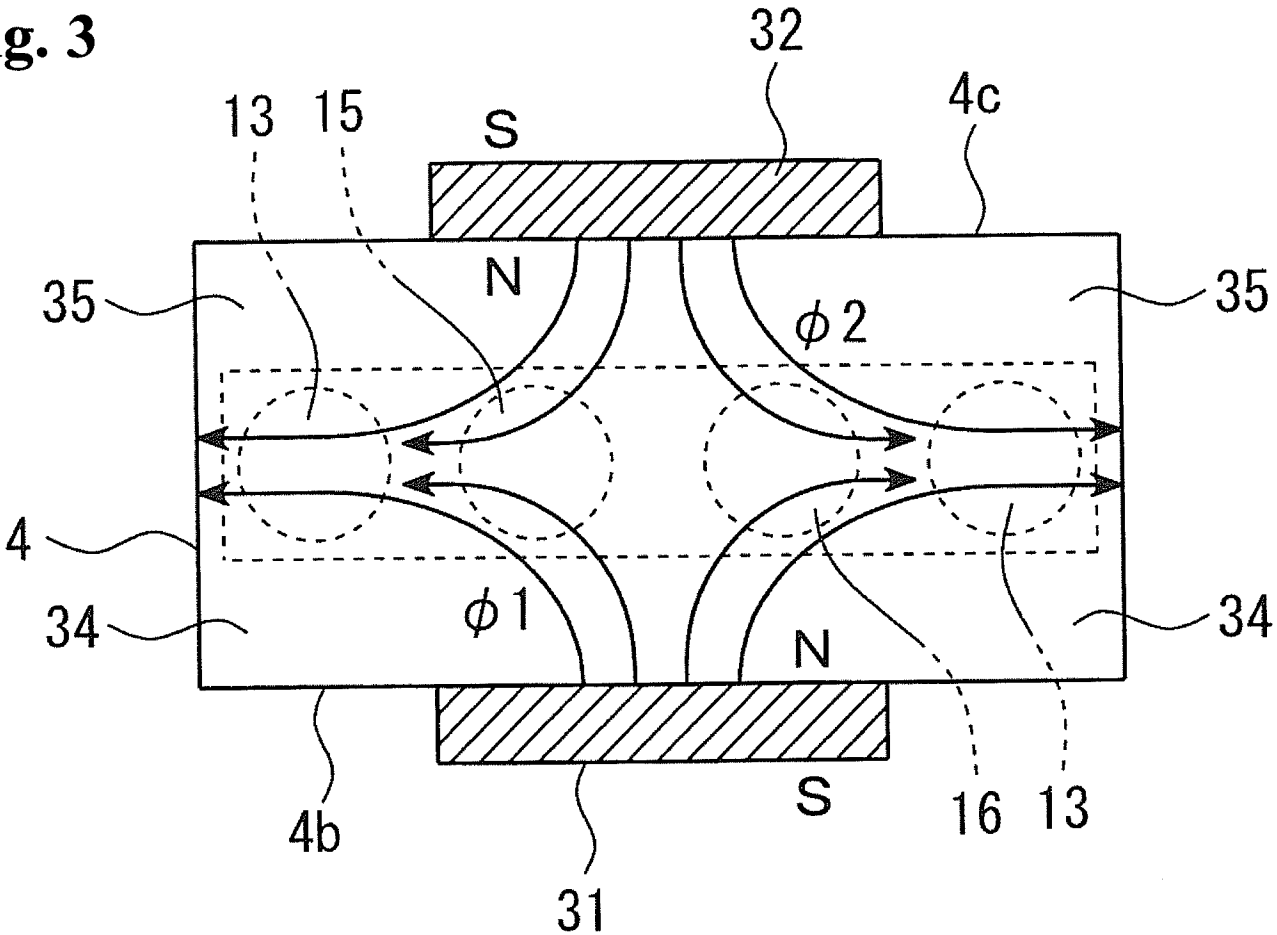
FIG. 3 illustrates magnetic fluxes produced by arc extinguishing magnetic bodies.

The arc extinguishing magnetic bodies 31 and 32 are so disposed that the center of the magnetic body in the longitudinal direction, which is the left and right direction in FIG. 3, corresponds with the center of the third stationary contact piece 9 in the left and right direction and that the left end of the magnetic body is placed between the first stationary contact piece 7 and the third stationary contact piece 9 and the right end of the magnetic body is placed between the second stationary contact piece 8 and the third stationary contact piece 9. As a result, the magnetic flux from the N-poles of the arc extinguishing magnetic bodies 31 and 32, as shown in the plan view of FIG. 3, passes through the space between the first movable contact piece 21 and the power supply side stationary contact pieces of the first stationary contact piece 7 and the third stationary contact piece 9 in the direction of the row of the stationary contact pieces of the stationary contact 5. The magnetic flux from the N-poles also passes through the space between the second movable contact piece 22 and the load side stationary contact pieces of the third stationary contact piece 9 and the second stationary contact piece 8 in the direction of the row of the stationary contact pieces of the stationary contact 5.

The magnetic flux from the N-poles of the arc extinguishing magnetic bodies 31 and 32 is separated, in the plan view, towards left and right at the central region in the longitudinal direction. One branch Φ1 of the magnetic flux passes along the magnetic path including the space between the opposing stationary contact portion 15 of the third stationary contact piece 9 and the first movable contact piece 21, the space between the opposing stationary portion 13 of the first stationary contact piece 7 and the first movable contact piece 21, and the space outside the contact support casing 4 in the left, and terminating at the S-poles of the arc extinguishing magnetic bodies 31 and 32. The other branch Φ2 of the magnetic flux passes along the magnetic path including the space between the opposing stationary contact portion 16 of the third stationary contact piece 9 and the second movable contact piece 22, the space between the opposing stationary portion 13 of the second stationary contact piece 8 and the second movable contact piece 22, and the space outside the contact support casing 4 in the right and terminating at the S-poles of the arc extinguishing magnetic bodies 31 and 32.

Figure 6:
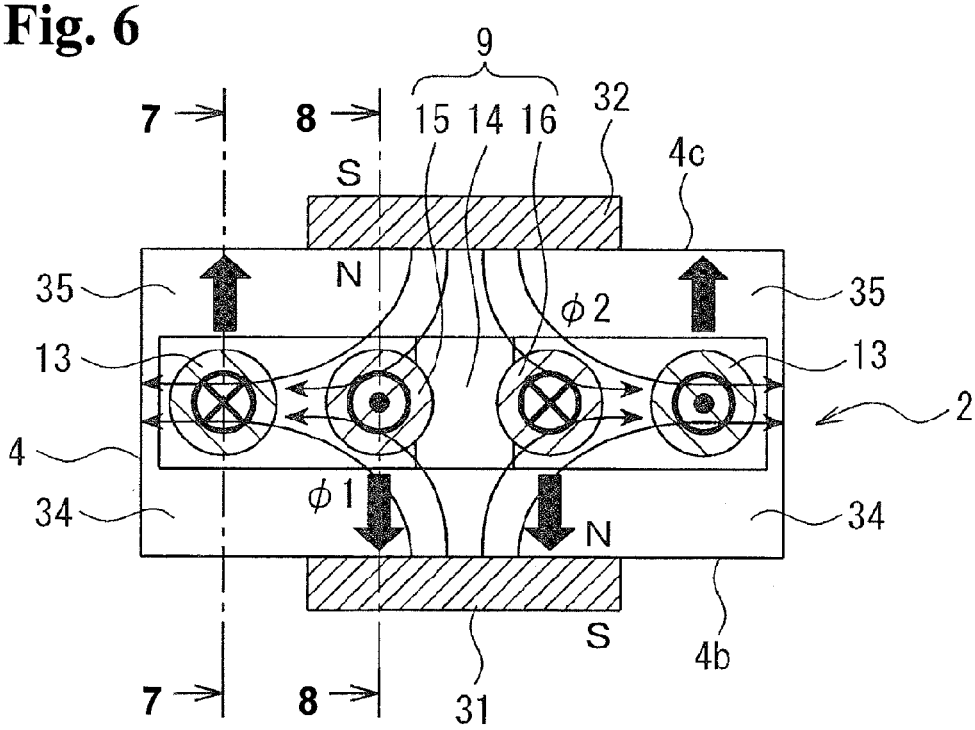
FIG. 6 is a cross-sectional view taken along line 6-6 in FIG. 5, indicating the direction of action of Lorenz force corresponding to the directions of the arc current and the magnetic flux generated by the permanent magnets.
Figure 7:
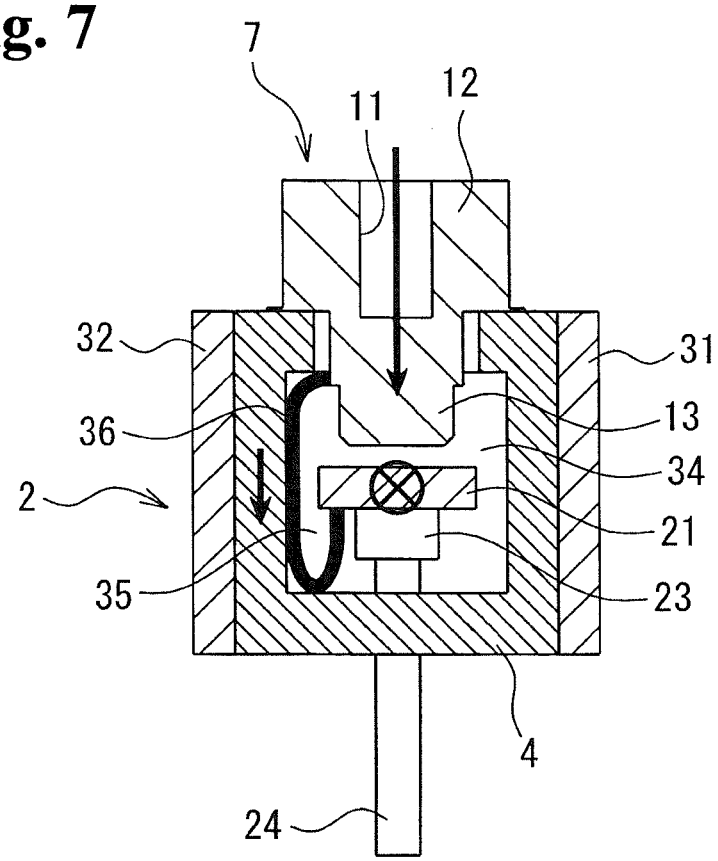
FIG. 7 is a cross-sectional view taken along line 7-7 in FIG. 6, showing a configuration of an extended arc.
Figure 8:
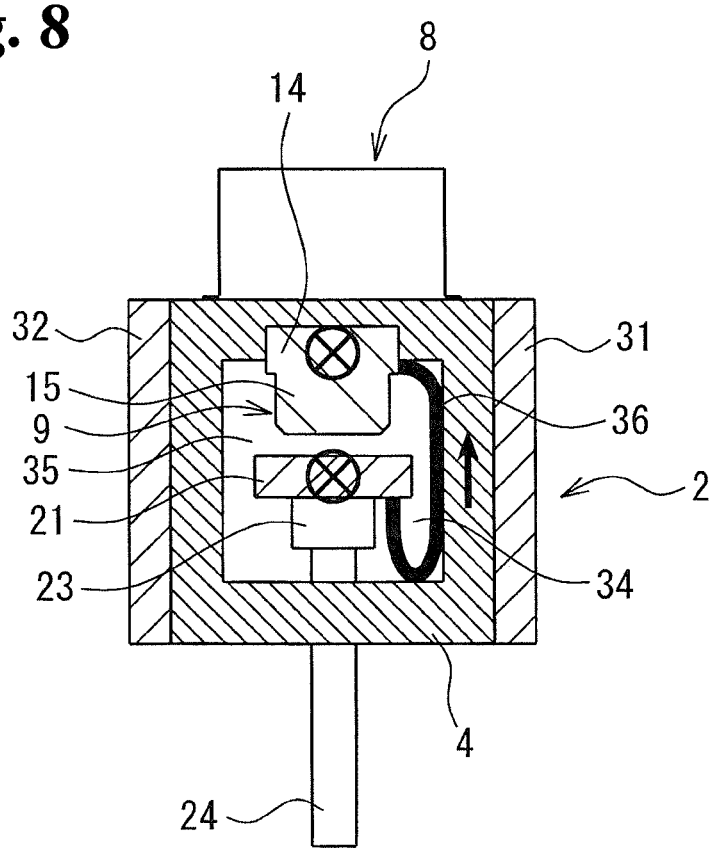
FIG. 8 is a cross-sectional view taken along line 8-8 in FIG. 6, showing a configuration of an extended arc.
Figure 9:
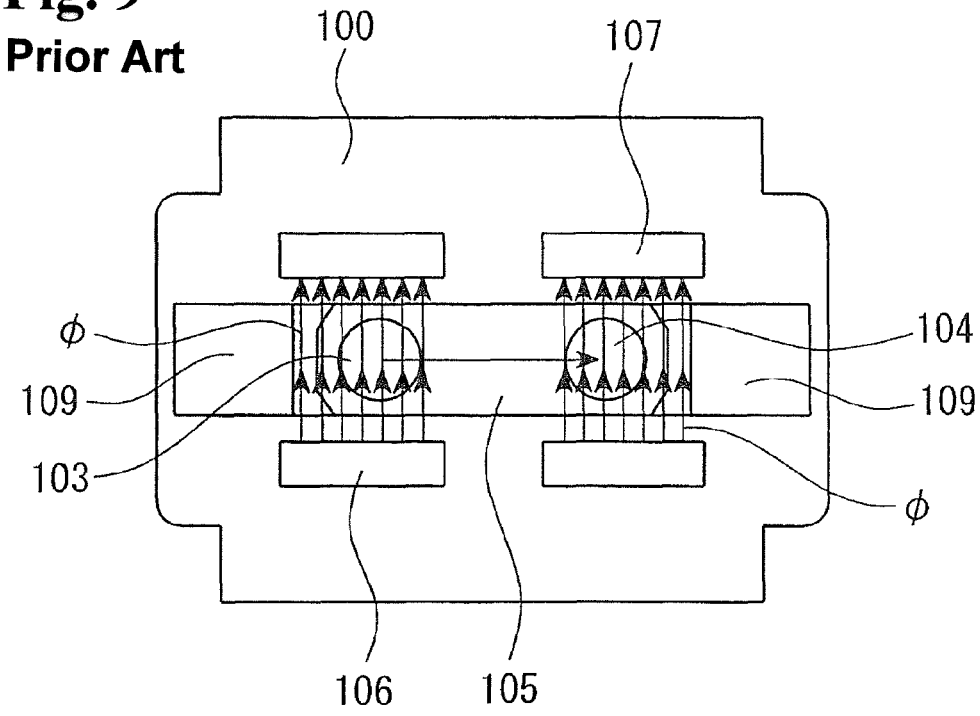
Fig. 9 Prior Art
FIG. 9 is a cross-sectional view of an example of a conventional device.
Figure 10:
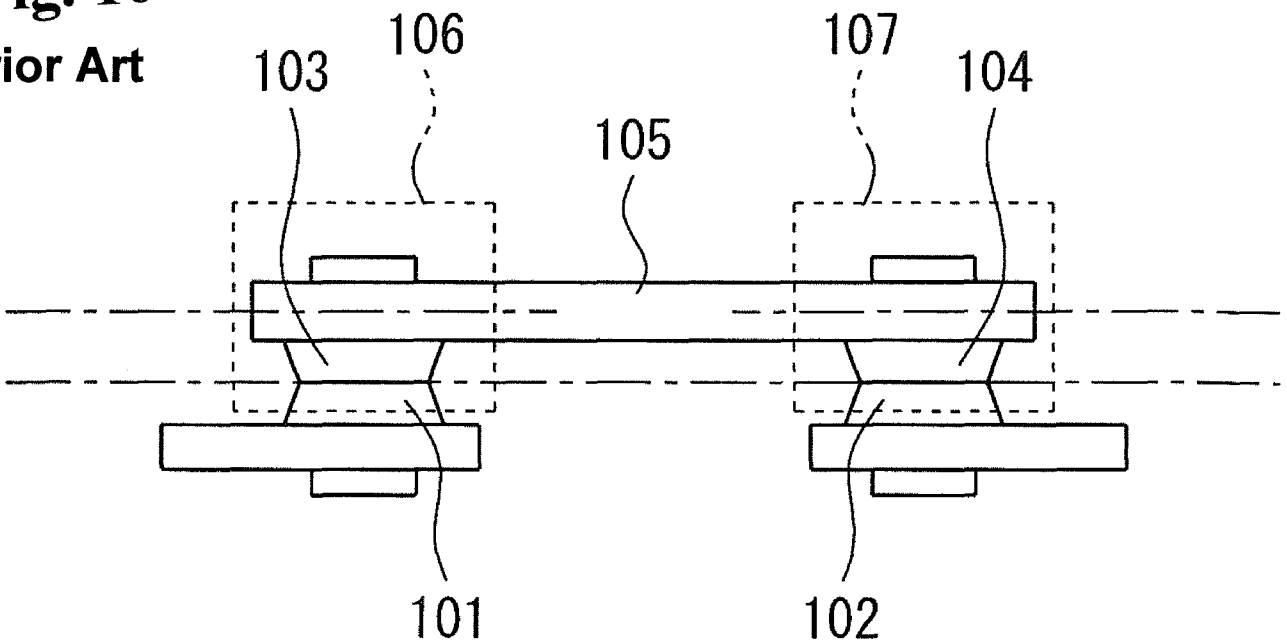
Fig. 10 Prior Art
FIG. 10 schematically shows relative arrangement of contact places and arc extinguishing means in the current carrying state in an example of conventional device.
Figure 11:
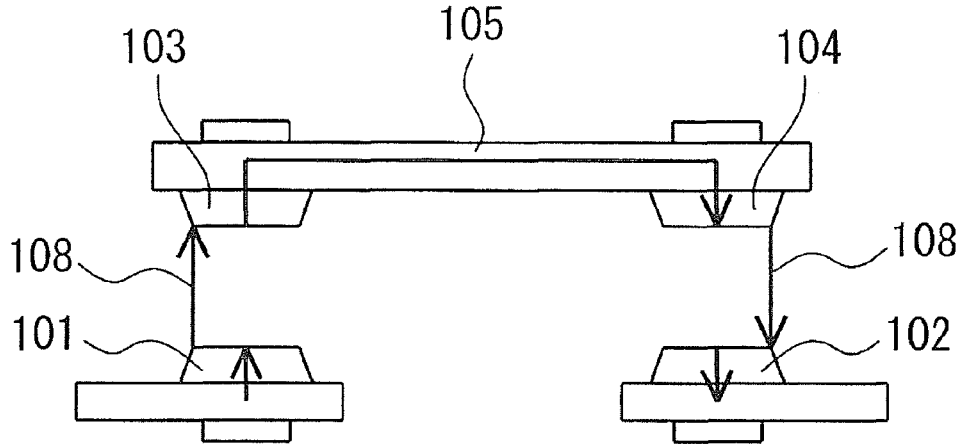
Fig. 11 Prior Art
FIG. 11 illustrates current path and arc generation in an example of conventional device.
Figure 12:
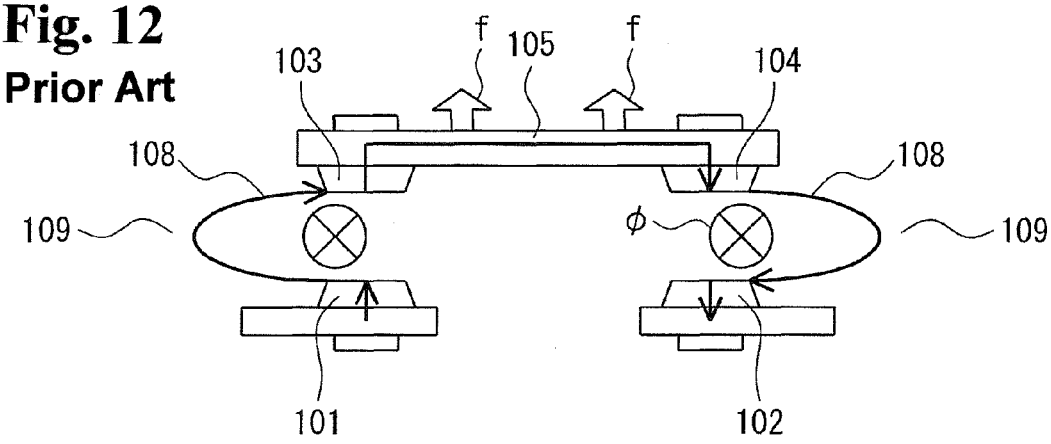
Fig. 12 Prior Art
FIG. 12 schematically shows relation among the current path, the configuration of the arc, and the magnetic flux generated by the arc extinguishing means in the current interrupting process in an example of conventional device.
Figure 13:
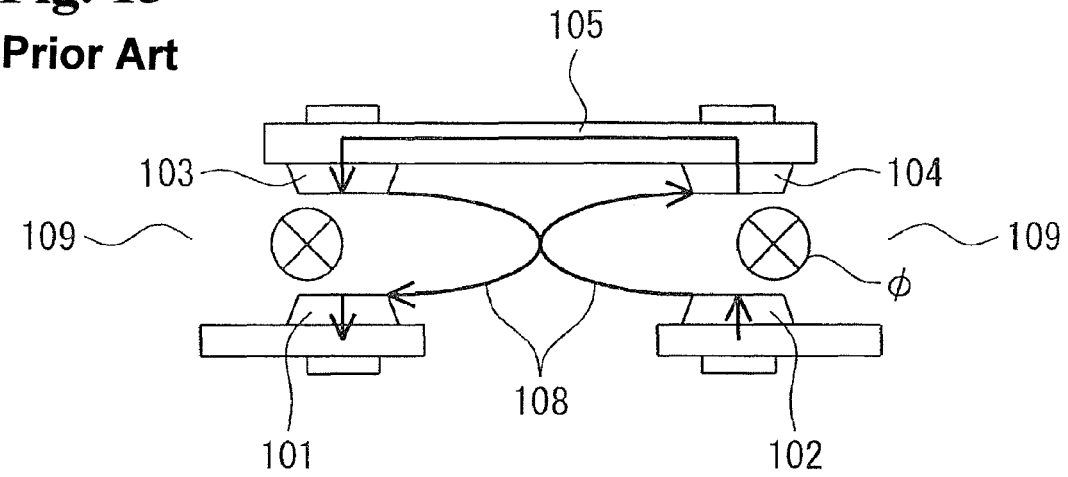
Fig. 13 Prior Art
FIG. 13 is a drawing similar to FIG. 12 in an example of conventional device but the direction of the current flow is reversed.

Arc extinguishing spaces 34 and 35 are formed inside inner surfaces of the side walls of the contact support casing 4 on which the pair of the arc extinguishing magnetic bodies is disposed as specifically described in the following. A part of the arc extinguishing space 34 in the power supply side is formed between the inner surface of the side wall of the contact support casing 4 in the side of the arc extinguishing magnetic body 31 and the three contact parts of stationary contact portion 13 of the first stationary contact piece 7, the stationary contact portion 15 of the third stationary contact piece 9, and the first movable contact piece 21 as shown in FIGS. 7 and 8, which are cross-sectional view cut along the line 7-7 and the line 8-8, respectively, in FIG. 6. A part of the arc extinguishing space 35 in the power supply side is formed between the inner surface of the side wall of the contact support casing 4 in the side of the arc extinguishing magnetic body 32 and the three contact parts of stationary contact portion 13 of the first stationary contact piece 7, the stationary contact portion 15 of the third stationary contact piece 9, and the first movable contact piece 21, as shown in FIGS. 7 and 8. The remainder of the arc extinguishing space 34 in the load side, which is the extension of the part of the arc extinguishing space 34 in the power supply side described above, is formed between the inner surface of the side wall of the arc extinguishing magnetic body 31 and the three contact parts of stationary contact portion 13 of the second stationary contact piece 8, the stationary contact portion 16 of the third stationary contact piece 9, and the second movable contact piece 22 as shown in FIG. 6. The remainder of the arc extinguishing space 35 in the load side, which is the extension of the arc extinguishing space 35 in the power supply side described above, is formed between the inner surface of the side wall of the contact support casing 4 in the side of the arc extinguishing magnetic body 32 and the three contact parts of stationary contact portion 13 of the second stationary contact piece 8, the stationary contact portion 16 of the third stationary contact piece 9, and the second contact piece 22 as shown in FIG. 6.

Now, operation of the magnetic contactor of an embodiment of the invention will be described in detail in the following.

A situation is considered now in which the stationary terminal portion 12 of the first stationary contact piece 7 is connected to wiring to a high voltage DC power supply, and the stationary terminal portion 12 of the second stationary contact piece 8 is connected to wiring to a load.

When the excitation coil (not depicted) in the driving mechanism 3 is not supplied with current in this situation, the shaft 24 of the movable contact 6 is pushed down by a return spring (not depicted) provided in the driving mechanism 3, making the contact mechanism in the released state, or an opened state, as shown in FIG. 2. In the released state, the first movable contact piece 21 is separated downward from the stationary contact portion 13 of the first stationary contact piece 7 and the stationary contact portion 15 of the third stationary contact piece 9 with a predetermined distance. The second movable contact piece 22 is also separated downward from the stationary contact portion 13 of the second stationary contact piece 8 and the stationary contact portion 16 of the third stationary contact piece 9 with the predetermined distance. Electric current cannot flow between the first stationary contact piece 7 and the second stationary contact piece 8, and the magnetic contactor is in a current interruption state in which a current is not supplied by the high voltage DC power supply to the load.

Figure 4:
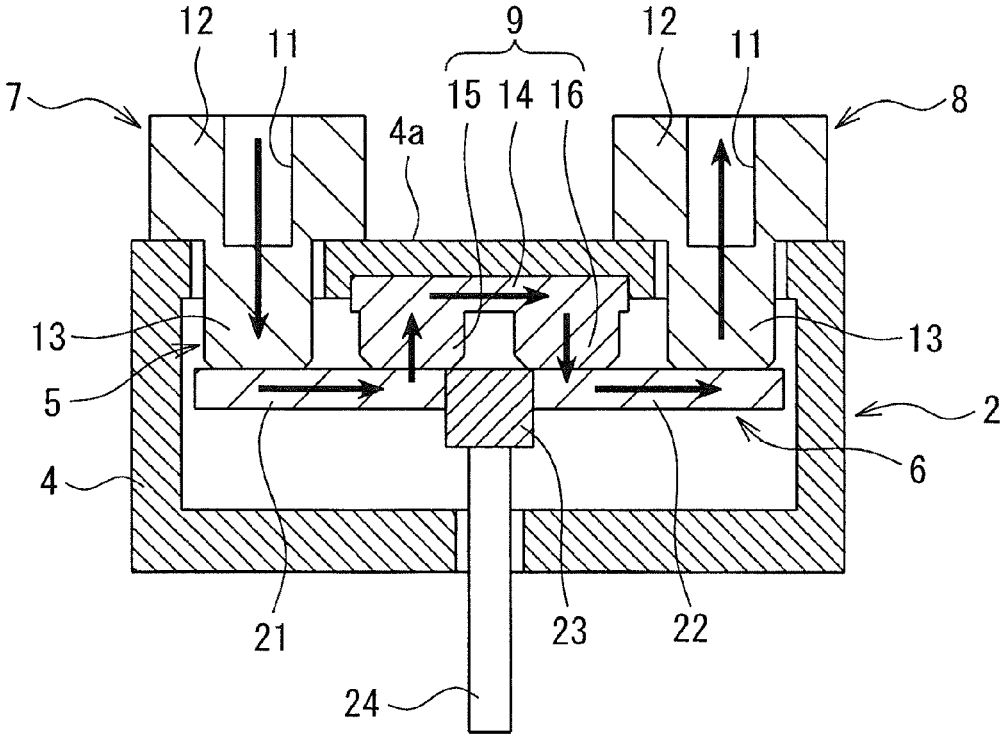
FIG. 4 is a cross-sectional view illustrating the current path in the closed state of the magnetic contactor.

Upon energizing the excitation coil of the driving mechanism 3 from the opened state of the contact mechanism 2, a plunger (not depicted) provided in the driving mechanism 3 is moved upward against the return spring force to push the shaft 24 for the movable contact 6 upward. As a result, the contact mechanism 2 turns into a closed state as shown in FIG. 4, in which the first movable contact piece 21 contacts the stationary contact portion 13 of the first stationary contact piece 7 and the stationary contact portion 15 of the third stationary contact piece 9, and the second movable contact piece 22 contacts the stationary contact portion 16 of the third stationary contact piece 9 and the stationary contact portion 13 of the second stationary contact piece 8.

As a consequence, the magnetic contactor becomes a current supplying state in which a current is supplied from the power supply to the load. In this state, the current delivered to the stationary terminal portion 12 of the first stationary contact piece 7 goes through the stationary contact portion 13 of the first stationary contact piece 7 and the first movable contact piece 21 and enters into the stationary contact portion 15 of the third stationary contact piece 9. The current subsequently runs through the flat plate portion 14 and the stationary contact portion 16 of the third stationary contact piece 9 and the second movable contact piece 22 and enters into the stationary contact portion 13 of the second stationary contact piece 8. From the stationary terminal portion 12 of this second stationary contact piece 8, the current is delivered to the load.

Figure 5:
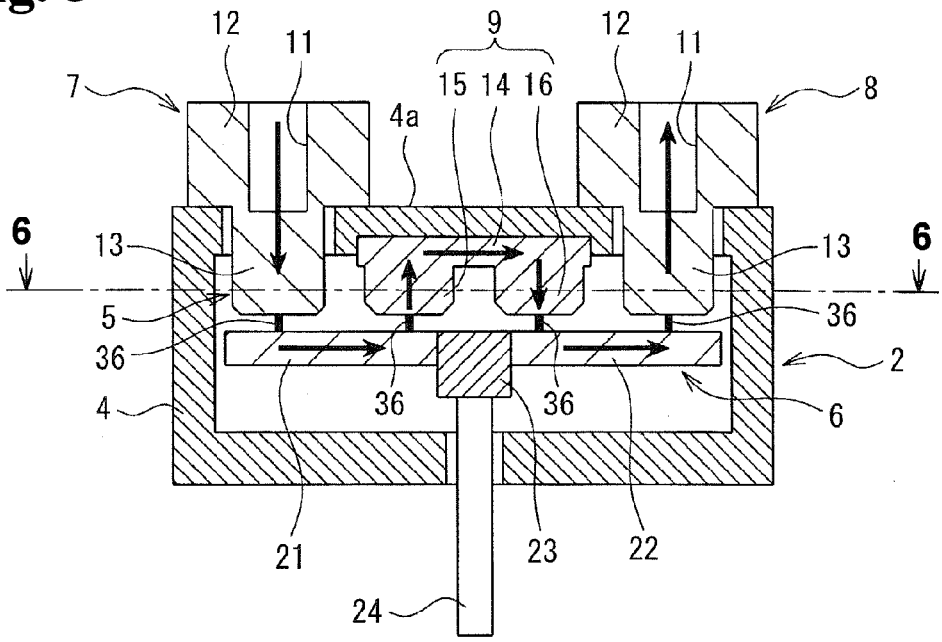
FIG. 5 is a cross-sectional view illustrating generation of arcs during transition from the closed state to the opened state of the magnetic contactor.

When the current supply to the excitation coil of the driving mechanism 3 is interrupted to terminate this current supplying state, the plunger (not depicted) starts to move downward by the force of the return spring. In the contact mechanism 2 as shown in FIG. 5, the first movable contact piece 21 starts to separate from the stationary contact portion 13 of the first stationary contact piece 7 and the stationary contact portion 15 of the third contact piece 9. At the same time, the second movable contact piece 22 starts to separate from the stationary contact portion 16 of the third contact piece 9 and the stationary contact portion 13 of the second stationary contact piece 8. In this process, arcs 36 develop on the power supply side between the first movable contact piece 21 and the stationary contact portion 13 of the first stationary contact piece 7 and between the first movable contact piece 21 and the stationary contact portion 15 of the third contact piece 9. The arcs 36 also develop in the load side between the second movable contact piece 22 and the stationary contact portion 16 of the third contact piece 9 and between the movable contact piece 22 and the stationary contact portion 13 of the second contact piece 8. Thus, a total of four arcs develop. The arcs cause the current-flowing state to continue in the power supply side and the load side.

The arc extinguishing magnetic bodies 31 and 32 are so arranged that the opposing magnetic pole faces are both N-poles as described previously. The magnetic flux out of the N-poles in the power supply side goes leftward in the direction of the row of stationary contact pieces through the space between the stationary portion 15 of the third stationary contact piece 9 and the first movable contact piece 21 and the space between the stationary contact portion 13 of the first stationary contact piece 7 and the first movable contact piece 21. As a consequence, the arc between the stationary contact portion 13 of the first stationary contact piece 7 and the first movable contact piece 21 is subjected, as shown in FIG. 6, to a Lorenz force in the direction perpendicular to the row of stationary contact pieces and toward the side of the arc extinguishing magnetic body 32 according to the Fleming's left hand rule in which the current is in the downward direction with respect to the page of FIG. 6 and the magnetic field is leftward. On the other hand, the arc between the stationary contact portion 15 of the third stationary contact piece 9 and the movable contact piece 21 is subjected to a Lorenz force in the direction perpendicular to the row of stationary contact pieces and toward the side of arc extinguishing magnetic body 31 according to the Fleming's left hand rule in which the current is in the upward direction with respect to the page of FIG. 6.

Similarly, in the load side, the magnetic flux out of the N-poles of the opposing magnetic pole faces of the arc extinguishing magnetic bodies 31 and 32 goes rightward in the direction of the row of stationary contact pieces through the space between the stationary portion 16 of the third stationary contact piece 9 and the second movable contact piece 22 and the space between the stationary portion 13 of the second stationary contact piece 8 and the second movable contact piece 22. As a consequence, the arc between the stationary contact portion 16 of the third stationary contact piece 9 and the second movable contact piece 22 is subjected, as shown in FIG. 6, to a Lorenz force in the direction perpendicular to the row of stationary contact pieces and toward the side of the arc extinguishing magnetic body 31 according to the Fleming's left hand rule in which the current is in the downward direction with respect to the page of FIG. 6. The arc between the stationary contact portion 13 of the second stationary contact piece 8 and the second movable contact piece 22 is subjected to a Lorentz force in the direction perpendicular to the row of stationary contact pieces and toward the side of arc extinguishing magnetic body 32 according to the Fleming's left had rule in which the current is in the upward direction with respect to the page of FIG. 6.

Consequently, the arc between the stationary contact portion 13 of the first stationary contact piece 7 and the first movable contact piece 21 is extended, as shown in FIG. 7 which is a cross-sectional view taken along the line 7-7 in FIG. 6, to the arc extinguishing space 35 and takes eventually a configuration starting from the bottom region of the stationary contact portion 13 of the first stationary contact piece 7 and ending at the bottom surface region of the first movable contact piece 21 and is extinguished from this configuration.

The arc between the stationary contact portion 15 of the third stationary contact piece 9 and the first movable contact piece 21 is extended, as shown in FIG. 8 which is a cross-sectional view taken along the line 8-8 in FIG. 6, to the arc extinguishing space 34 and takes eventually a configuration starting from the bottom region of the stationary contact portion 15 of the third stationary contact piece 9 and ending at the bottom surface region of the first movable contact piece 21 and is extinguished from this configuration.

Similarly in the load side, the arc developed between the stationary contact portion 16 of the third stationary contact piece 9 and the second movable contact piece 22 is extended into the arc extinguishing space 34 and extinguished there. The arc developed between the stationary contact portion 13 of the second stationary contact piece 8 and the second movable contact piece 22 is extended into the arc extinguishing space 35 and extinguished there.

In the connected state of the magnetic contactor 1, when a regenerative current is flowing from the load to the DC power supply and current interruption is to be conducted from this state, the same arc extinguishing operation is performed except that the direction of the Lorenz force is reversed with respect to the line of the row of stationary contact pieces due to the reversed direction of the current from the direction in FIG. 6.

In the process of transition from the closed state to the opened state in the embodiment according to the invention, four arcs are generated, which are two more arcs compared with those in the conventional devices. Since each of the four arcs is extended into the arc extinguishing space 34 or 35, the extended total arc length can be elongated. Therefore, the same size of a magnetic contactor as the conventional one can interrupt a higher voltage.

Since the arc extinguishing spaces for extending the developed arc are different in both the power supply side and the load side, interference of the arcs does not take place, and the distance between adjacent stationary contact portions of contact pieces can be reduced.

The stationary terminal portions 12 of the first stationary contact piece 7 and the second stationary contact piece 8 have a female screw hole for attaching an external wiring terminal. Therefore, the stationary contact pieces 7 and 8 are hardly minimized and have their limitation in reduction of the distance therebetween. The third stationary contact piece 9 is disposed in this space between the first and second stationary contact pieces in the magnetic contactor of the invention, effectively utilizing this space with the dimensional limitation. Therefore, the arc extinguishing performance is improved while an overall size is not enlarged.

The Lorenz force exerted on the arc reverses its direction when the direction of the current that flows between the stationary contact and the movable contact is altered. The arc is extended either toward the space 34 in the side of the arc extinguishing magnetic body 31 or toward the space 35 in the side of the arc extinguishing magnetic body 32, both the spaces, the arc extinguishing spaces 34 and 35, being located in both sides of the movable contact pieces 21 and 22 extending in their longitudinal direction. Toward which of the arc extinguishing magnetic bodies 31 and 32 the arc extends is determined by the direction of the current between the stationary contact portion and the movable contact piece. Since the arc extinguishing spaces 34 and 35 are provided in both sides of the movable contact pieces 21 and 22, the arc extinguishing function is certainly performed irrespective of the direction of the arc current between the stationary contact portion and the movable contact piece.

Therefore, the present invention provides a small-sized magnetic contactor exhibiting a satisfactory arc extinguishing function for a high voltage power supply irrespective of the direction of the current through the contact.

In the embodiment example described above, the arc extinguishing spaces 34 and 35 are formed extending throughout the power supply side and the load side. However, each of the arc extinguishing spaces 34 and 35 can be separated to form a space in the power supply side and a space in the load side by a partition wall having an insulating material provided at the middle between the power supply side and the load side. According to this configuration, interference of arcs is avoided without failure by separating, with the partition wall, the arc developed between the stationary contact portion 15 of the third stationary contact piece 9 and the first movable contact piece 21 and the arc developed between the stationary contact portion 16 of the third stationary contact piece 9 and the second movable contact piece 22.

In the embodiment example described above, the opposing magnetic pole faces of the arc extinguishing magnetic bodies 31 and 32 are N-poles. However, the opposing magnetic pole faces of the arc extinguishing magnetic bodies 31 and 32 can be S-poles. In this case, the magnetic flux out of the N-poles on the outer surface of the arc extinguishing magnetic bodies 31 and 32 goes in the power supply side through the space between the stationary contact portion 13 of the first stationary contact piece 7 and the first movable contact piece 21 and the space between the stationary contact portion 15 of the third stationary contact piece 9 and the first movable contact piece 21, and returns to the S-poles of the arc extinguishing magnetic bodies 31 and 32. Similarly in the load side, the magnetic flux goes through the space between the stationary contact portion 13 of the second stationary contact piece 8 and the second movable contact piece 22 and the space between the stationary contact portion 16 of the third stationary contact piece 9 and the second movable contact piece 22, and returns to the S-poles of the arc extinguishing magnetic bodies 31 and 32. Therefore, the same effects are obtained as those in the embodiment example described above although the direction of the Lorenz force is reversed.

What is claimed is:

1. A magnetic contactor, comprising:

a stationary contact including a first stationary contact piece having a stationary contact portion and a stationary terminal portion for connecting to a power supply, a second stationary contact piece having a stationary contact portion and a stationary terminal portion for connecting to a load, a third stationary contact piece disposed between the first stationary contact piece and the second stationary contact piece and having two stationary contact portions;

a contact support casing supporting the stationary contact with the stationary terminal portions of the first stationary contact piece and the second stationary contact piece to protrude out of the contact support casing;

a movable contact including a first movable contact piece contactable and separable from the stationary contact portion of the first stationary contact piece and one of the two stationary contact portions of the third stationary contact piece, a second movable contact piece contactable and separable from the stationary contact portion of the second stationary contact piece and the other stationary contact portion of the third stationary contact piece, and an insulator fixing the first movable contact piece and the second movable contact piece, the movable contact being installed in the contact support casing;

a pair of arc extinguishing magnetic bodies arranged in parallel to sandwich the two stationary contact portions of the third stationary contact piece and the movable contact, and having some polarity at opposing magnetic pole faces; and a driving mechanism for driving the movable contact to contact with and separate from the stationary contact.

2. A magnetic contactor according to claim 1, wherein the opposing magnetic pole faces of the pair of arc extinguishing magnetic bodies are N-poles.

3. A magnetic contactor according to claim 1, wherein the opposing magnetic pole faces of the pair of arc extinguishing magnetic bodies are S-poles.

4. A magnetic contactor according to claim 1, wherein the pair of arc extinguishing magnetic bodies is disposed on outer surfaces of the contact support casing.

5. A magnetic contactor according to claim 1, wherein the contact support casing has arc extinguishing spaces therein at portions corresponding to the pair of arc extinguishing magnetic bodies.

6. A magnetic contactor according to claim 5, further comprising partition walls made of an insulating material and disposed in a central region of the arc extinguishing spaces, each of said partition walls dividing each of the arc extinguishing spaces into a portion on a side of the first movable contact piece and a portion on a side of the second movable contact piece.

7. A magnetic contactor according to claim 1, wherein the pair of arc extinguishing magnetic bodies extends only from an outer end of one of the two stationary contact portion of the third stationary contact piece to an outer end of another one of the two stationary contact portion of the third stationary contact piece without extending to side portions of the stationary contact portions of the first and second stationary contact pieces.

8. A magnetic contactor according to claim 7, wherein each of the arc extinguishing magnetic bodies has a height corresponding to that of the contact support casing.

* * * * *